US010625538B2

(12) United States Patent
Kim et al.

(10) Patent No.: US 10,625,538 B2
(45) Date of Patent: Apr. 21, 2020

(54) FOAMING PRINTING METHOD

(71) Applicant: KOLON GLOTECH, INC., Gwacheon (KR)

(72) Inventors: Il Beom Kim, Gumi (KR); Chan Yun, Gumi (KR)

(73) Assignee: KOLON GLOTECH, INC., Gwacheon (KR)

( * ) Notice: Subject to any disclaimer, the term of this patent is extended or adjusted under 35 U.S.C. 154(b) by 94 days.

(21) Appl. No.: 15/944,640

(22) Filed: Apr. 3, 2018

(65) Prior Publication Data

US 2019/0016174 A1 Jan. 17, 2019

(30) Foreign Application Priority Data

Jul. 12, 2017 (KR) ..... 10-2017-0088578

(51) Int. Cl.

| | |
|---|---|
| ***B44C 1/17*** | (2006.01) |
| ***B41M 5/025*** | (2006.01) |
| ***B41J 3/407*** | (2006.01) |
| ***D06N 3/00*** | (2006.01) |
| ***D06M 23/16*** | (2006.01) |
| ***D06M 23/04*** | (2006.01) |
| ***D06N 7/00*** | (2006.01) |
| ***D06Q 1/12*** | (2006.01) |
| ***B41M 3/12*** | (2006.01) |
| ***B41M 3/00*** | (2006.01) |
| ***B41M 1/38*** | (2006.01) |
| ***B41M 5/03*** | (2006.01) |
| ***B41M 5/00*** | (2006.01) |
| ***B41J 29/38*** | (2006.01) |

(Continued)

(52) U.S. Cl.

CPC ..... *B44C 1/1716* (2013.01); *B41M 1/38* (2013.01); *B41M 3/00* (2013.01); *B41M 3/12* (2013.01); *D06M 23/04* (2013.01); *D06M 23/16* (2013.01); *D06N 3/005* (2013.01); *D06N 3/0045* (2013.01); *D06N 3/0095* (2013.01); *D06N 7/0092* (2013.01); *D06Q 1/12* (2013.01); *B41M 1/28* (2013.01); *B41M 1/34* (2013.01); *B41M 5/0047* (2013.01)

(58) Field of Classification Search

CPC combination set(s) only.
See application file for complete search history.

(56) References Cited

U.S. PATENT DOCUMENTS 7,501,037 B2 * 3/2009 Stroup ..... E06B 3/822 156/250
2012/0263814 A1 * 10/2012 Faber ..... G03F 7/0017 425/174.4

(Continued)

*Primary Examiner* — Sing P Chan

(57) ABSTRACT

A foam printing method includes producing and programming a design being formed on a substrate using a computer program, forming the design on a plate, removing a part of a surface of the substrate along the design, combining the substrate and the plate to coincide a designed portion formed on the plate and a removed portion of the substrate, printing a foam constituting the design on the plate combined with the substrate, separating the plate from the substrate and drying the substrate, and applying a pressure to the foam passing the plate to be set on the substrate to be foamed. The foam passes the designed portion of the plate to be set on the removed portion of the substrate during the printing.

15 Claims, 7 Drawing Sheets

(51) Int. Cl.
*B41M 1/34* (2006.01)
*B41M 1/28* (2006.01)

(56) References Cited

U.S. PATENT DOCUMENTS

2017/0037674 A1* 2/2017 Hooper ..... E06B 3/12
2017/0162077 A1* 6/2017 Vara ..... B29C 44/022

* cited by examiner

【FIG. 1】
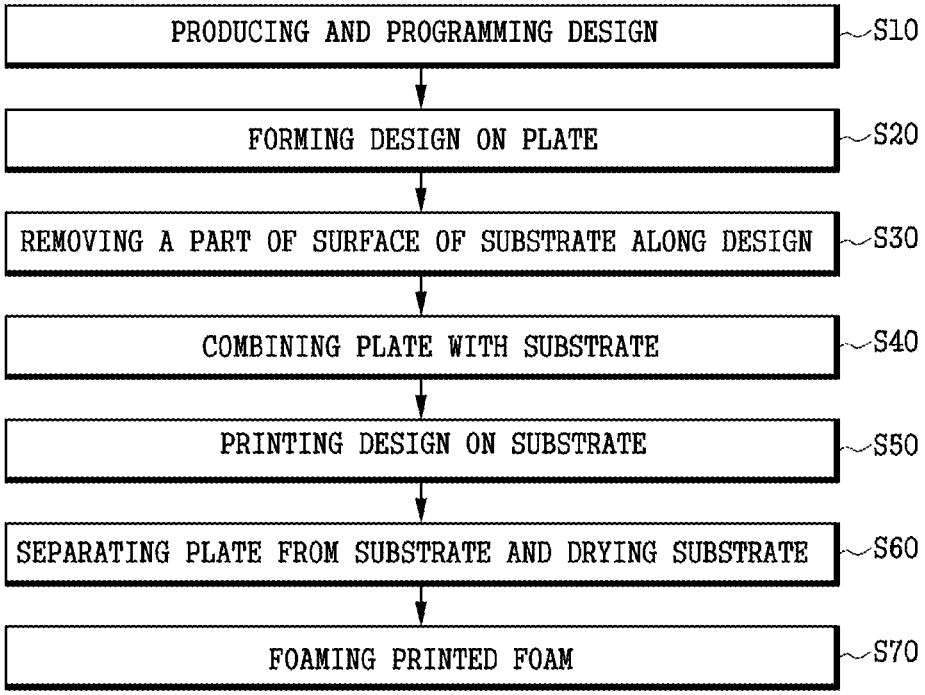

【FIG. 2】
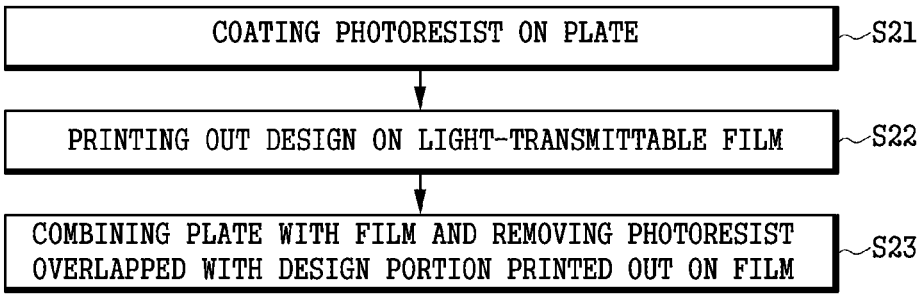

【FIG. 3】
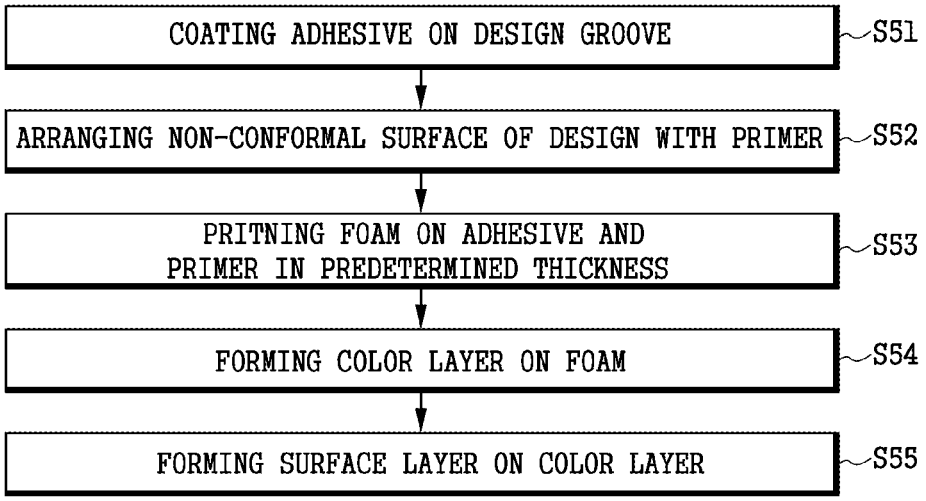

【FIG. 4】
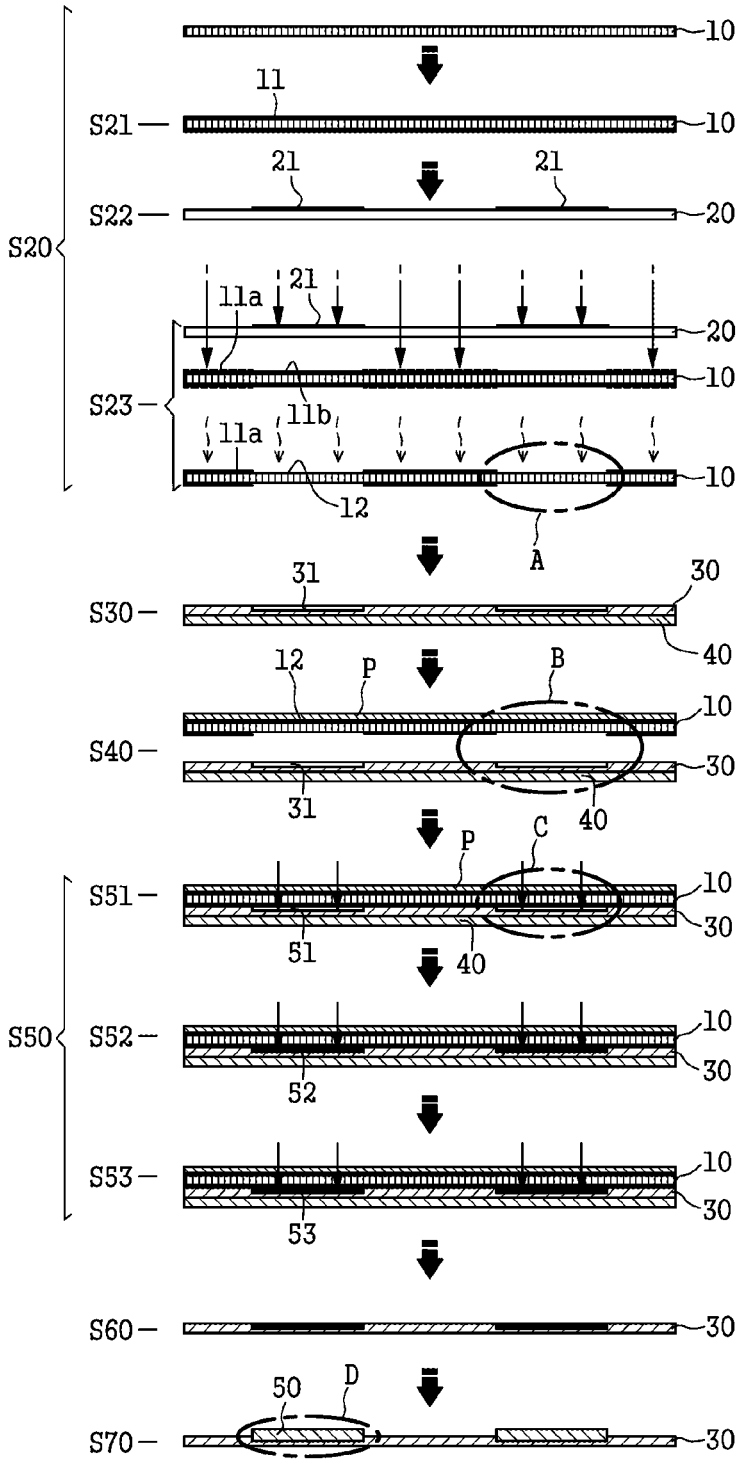

【FIG. 5】
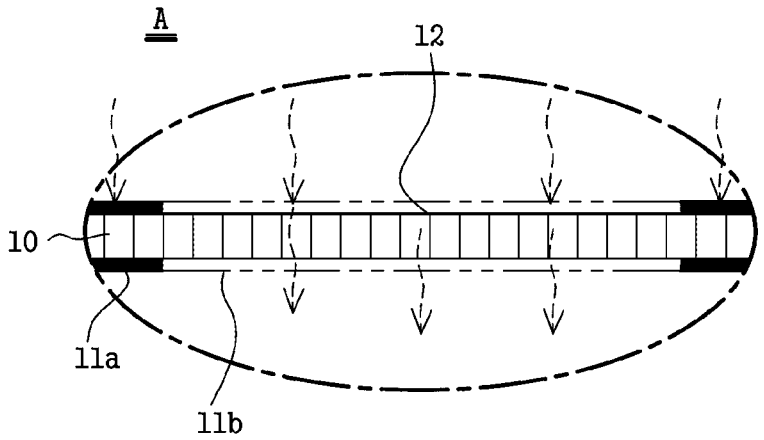
【FIG. 6】
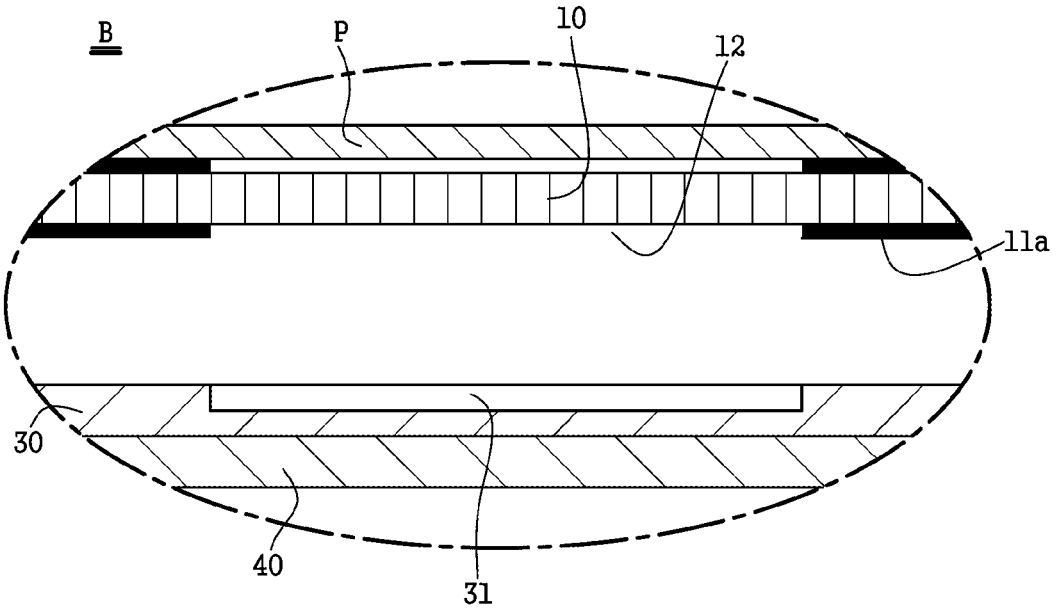

【FIG. 7】
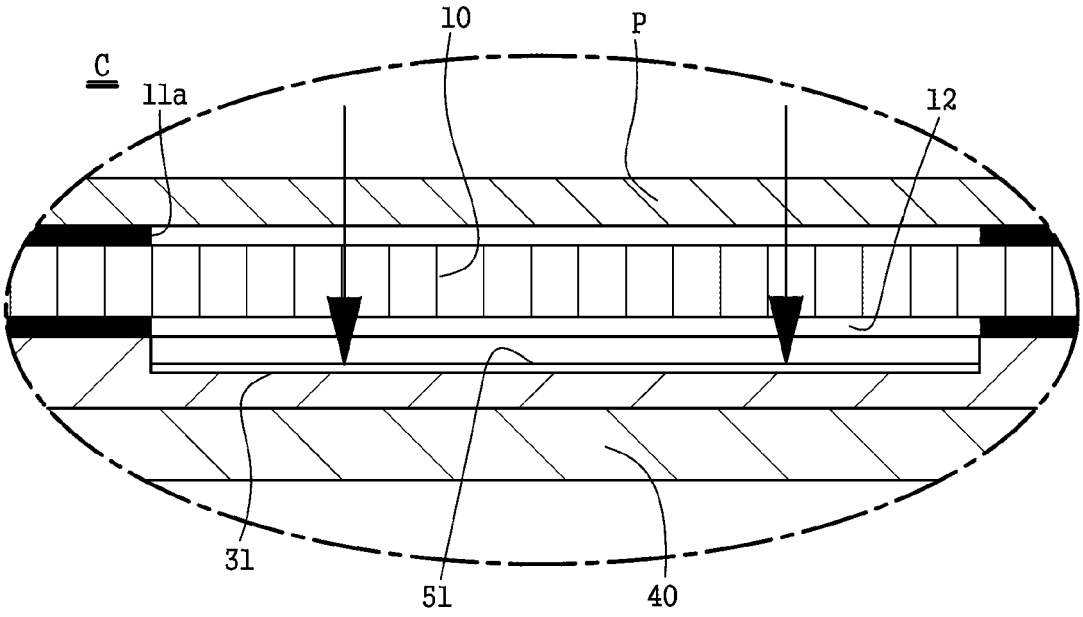
【FIG. 8】
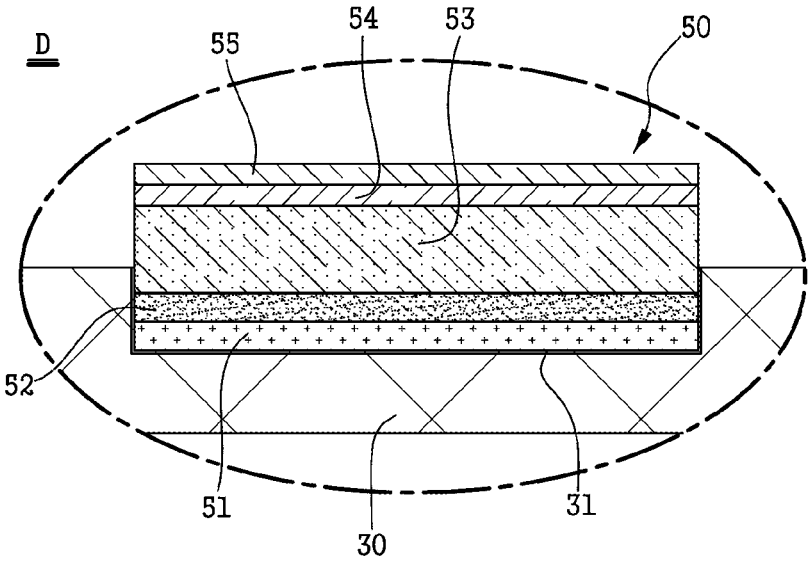

【FIG. 9】
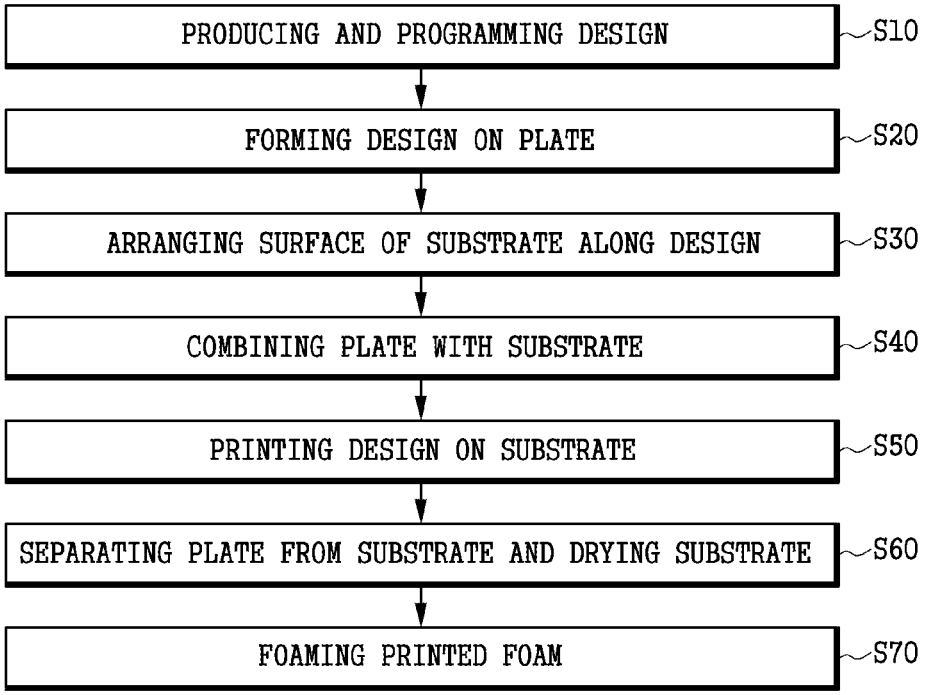

FOAMING PRINTING METHOD

CROSS REFERENCE TO RELATED APPLICATION

This application claims the benefit of Korean Patent Application No. 10-2017-0088578, filed Jul. 12, 2017, which is hereby incorporated by reference in its entirety into this application.

TECHNICAL FIELD

The present invention relates to a foaming printing method.

BACKGROUND ART

Generally, various kinds of leather goods go through several processes to have improved quality because only raw leathers do not in itself have properties satisfying the leather goods.

In specifically, among the several processes, soil-resistant finishing processes have been employed in order that pollutants are not stick to surfaces of leathers and pollutants adhered to leathers are decontaminated. Through the soil-resistant finishing processes, antifouling paints (silicone) are coated. Due to antifouling paints, it is difficult to form designs on surfaces of leathers using printing methods.

Accordingly, in order to form designs on surfaces of leathers coated with antifouling paints, welding or embroidery should be performed.

SUMMARY OF THE INVENTION

It is therefore an object of the present invention to provide a foaming printing method for printing various designs on leather surfaces.

Pursuant to embodiments of the present invention provides a foaming printing method comprising producing and programming a design being formed on a substrate using a computer program, forming the design on a plate, removing a part of a surface of the substrate along the design, combining the substrate and the plate to coincide a designed portion formed on the plate and a removed portion of the substrate, printing a foam constituting the design on the plate combined with the substrate, separating the plate from the substrate and drying the substrate, and applying a pressure to the foam passing the plate to be set on the substrate to be foamed. In this case, the foam passes the designed portion of the plate to be set on the removed portion of the substrate during the printing.

Pursuant to embodiments of the present invention, the forming the design on the plate further includes coating a photoresist on the plate, printing out the design on a light-transmittable film, and combining the plate with the film and removing the photoresist overlapped with the design printed out on the film. In this case, the photoresist is removed to form the design on the plate.

Pursuant to embodiments of the present invention, a design groove constituting the design is formed on the substrate by treating the surface of the substrate using a treatment apparatus inputting the programming during the part of the surface of the substrate along the design, and the foam is set to the design groove to be foamed.

Pursuant to embodiments of the present invention, the printing the design on the plate further comprises coating an adhesive agent on the design groove, arranging non-conformal surfaces of the design groove with a primer, printing the foam in a predetermined thickness on the adhesive agent and the primer, forming a color layer on the foam, and forming a surface layer on the color layer Pursuant to embodiments of the present invention, a depth of the design groove is ranged from 0.05 mm to 0.5 mm from the surface of the substrate.

Pursuant to embodiments of the present invention, the treatment apparatus is a laser beam machine and a frequency of the laser beam machine is 6 to 10 kHz and an operating speed of the laser beam machine is 800 to 1,000 mm/sec.

Pursuant to embodiments of the present invention, the plate is fixed to a printing apparatus and a jig attached to the substrate is moved to the printing apparatus to coincide the designed portion of the plate with the removed portion of the substrate during the combining the substrate and the plate to coincide the designed portion formed on the plate and the removed portion of the substrate.

Pursuant to embodiments of the present invention, the substrate is leather.

Pursuant to embodiments of the present invention, the substrate is dried at a temperature ranging from 60° C. to 90° C. for 6 to 12 hours.

Pursuant to embodiments of the present invention, a pressure ranging from 30 bar to 80 bar is applied to the substrate at a temperature ranging from 110° C. to 150° C. for 5 to 20 minutes during the applying the pressure to the foam to be foamed.

Pursuant to embodiments of the present invention provides a foaming printing method comprising producing and programming a design being formed on a substrate using a computer program forming the design on a plate, arranging a surface of the substrate where the design is formed, combining the substrate and the plate to coincide the plate and the substrate, printing a foam constituting the design on the plate combined with the substrate, separating the plate from the substrate and drying the substrate, and applying a pressure to the foam passing the plate to be set on the substrate to be foamed. In this case, the foam passes a designed portion of the plate to be set on a removed portion of the substrate during the printing.

Pursuant to embodiments of the present invention, the plate is fixed to a printing apparatus and a jig attached to the substrate is moved to the printing apparatus to coincide the plate with the substrate. In this case, the printing the design on the substrate further comprises arranging the surface by coating a primer on the surface of the substrate where the design is formed, printing the foam in a predetermined thickness on an adhesive agent and the primer, forming a surface layer on the foam, separating the plate from the printing apparatus and jig from the substrate, drying the substrate, and applying a pressure to the foam to be foamed.

Pursuant to embodiments of the present invention, the substrate is one of a fabric, a glass, and a metal.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 1 is a block diagram illustrating a foaming printing method according to an embodiment of the present invention;

FIG. 2 is a block diagram illustrating forming a design on the plate described in FIG. 1;

FIG. 3 is a block diagram illustrating printing a design on the substrate described in FIG. 1;

FIG. 4 is a process diagram illustrating a foam printing method according to an embodiment of the present invention;

FIG. 5 is a partial enlarged view of A portion of FIG. 4;

FIG. 6 is a partial enlarged view of B portion of FIG. 4;

FIG. 7 is a partial enlarged view of C portion of FIG. 4;

FIG. 8 is a partial enlarged view of D portion of FIG. 4; and

FIG. 9 is a block diagram illustrating a foaming printing method according to another embodiment of the present invention.

DETAILED DESCRIPTION

Hereinafter, the present invention will be described in detail with reference to the drawings. In describing the present invention, detailed descriptions related to publicly known functions or configurations will be omitted in order not to obscure the gist of the present invention.

As used herein, the phrase "accessed" or "connected" refers that one element is directly accessed or connected to other element, or other element is formed therebetween. On the other hand, as used herein, the phrase "directly accessed" or "directly connected" refers that there is no element therebetween.

A foam printing method in accordance with an embodiment of the present invention will be described in more detail with reference to FIGS. 1 to 3.

FIG. 1 is a block diagram illustrating a foaming printing method according to an embodiment of the present invention. FIG. 2 is a block diagram illustrating forming a design on the plate described in FIG. 1. FIG. 3 is a block diagram illustrating printing a design on the substrate described in FIG. 1. FIG. 4 is a process diagram illustrating a foam printing method according to an embodiment of the present invention. FIG. 5 is a partial enlarged view of A portion of FIG. 4. FIG. 6 is a partial enlarged view of B portion of FIG. 4. FIG. 7 is a partial enlarged view of C portion of FIG. 4. FIG. 8 is a partial enlarged view of D portion of FIG. 4 and FIG. 9 is a block diagram illustrating a foaming printing method according to another embodiment of the present invention.

Referring to FIGS. 1 to 3, the foam printing method comprises producing and programming a design being formed on a substrate using a computer program (S10), forming the design on a plate (S20), removing a part of a surface of the substrate along the design (S30), combining the substrate and the plate (S40), printing the design on the substrate (S50), separating the plate from the substrate and drying the substrate (S60), and foaming the foam (S70).

The forming the design on the plate (S10) includes coating a photoresist on the plate (S21), printing out the design on a light-transmittable film (S22), and combining the plate with the film and removing the photoresist overlapped with the design printed out on the film (S23). In this case, the photoresist is removed to form the design on the plate.

During the part of the surface of the substrate along the design (S30), a design groove 31 constituting the design is formed on the substrate by treating the surface of the substrate using a treatment apparatus inputting the programming and the foam is set to the design groove to be foamed.

The printing the design on the substrate (S50) comprises coating an adhesive agent on the design groove (S51), arranging non-conformal surfaces of the design groove with a primer (S52), printing the foam in a predetermined thickness on the adhesive agent and the primer (S53), forming a color layer on the foam (S54), and forming a surface layer on the color layer (S55).

During the combining the substrate and the plate (S40), the plate is fixed to a printing apparatus and a jig attached to the substrate is moved to the printing apparatus to coincide the designed portion of the plate with the removed portion of the substrate.

The substrate according to an embodiment of the present invention is a leather. The leather is natural leather or artificial leather. Leather surfaces are treated with antifouling composition to be protected from the outside.

Referring to FIGS. 4 to 8, during the producing and programming the design, users plan a design to be formed on the substrate and create a program for driving the treatment apparatus based on the design. In planning the design, a computer aided design (CAD) can be employed, but not limited thereto.

During the forming the design on the plate (S20), the plate with a predetermined area 10 is prepared. The plate a mesh member made of polyester or stainless steel and a frame arranged along the outline of the mesh member. The frame is made of aluminum. The mesh denier is ranging from 25 to 30. Holes of 180 to 200 units are formed within 1 inch width and length of the mesh. The photoresist 11 is coated on one and the other sides of the mesh member (S21).

The design produced by the computer is output on a light-transmittable film 20. Light does not transmit the output designed portion 21. The plate 10 and the film 20 in which the design is output are combined, and then light is irradiated on the film 20. In this case, a photoresist portion 11*a* in contact with light becomes cured, and a photoresist portion 11*b* not in contact with light is not cured. The plate 10 is washed out so that the non-cured photoresist portion 11*b* is washed out and the mesh member is exposed (S23). By repeatedly operating light irradiation, cleaning, and drying using photography developing method, the design is formed on the mesh member. The exposed portion of the mesh member is equivalent to a design portion 12. Accordingly, a mesh portion in which the photoresist is cured is covered by the photoresist so that holes of the mesh are plugged. Holes of a mesh portion constituting the design portion by washing out the photoresist 12 are not plugged.

During the removing the part of surfaces along the design S30, a program is input to the treatment apparatus. The treatment apparatus is a laser beam machine with a numerical controller. Laser beam is irradiated on surfaces of the substrate 30 fixed to a jig 40 along the input program, thereby partially melting the surfaces of the substrate 30 to remove antifouling paint and a part of the substrate 30. A frequency of the laser beam machine is 6 to 10 kHz and an operating speed of the laser beam machine is 800 to 1,000 mm/sec.

As a result, the antifouling paint coated on the surfaces of the substrate 30 is removed to form a design groove 31. The depth of the design groove 31 is ranged from 0.05 mm to 0.5 mm from the surface of the substrate. If the depth of the design groove 31 is less than 0.05 mm, the fixation of a foaming layer 53 may be decreased. If the depth of the design groove 31 is excesses 0.5 mm, the thickness of the substrate 30 is increased, thereby rising a production cost.

The design portion 12 on the plate 10 and design groove 31 on the substrate 30 are formed uniformly.

During the combining the plate 10 and substrate 30 (S40), the substrate 30 is coupled with the jig having a predetermined area. The design groove 31 on the substrate 30 is formed with combining with the jig 40. However, the substrate 30 in which the design groove 31 may be coupled with the jig 40.

The area of the jig 40 is formed larger than that of substrate 30. In order to fix the substrate 30 with the jig 40, combining means such as a double-sided tape or a clamp (not shown) may be employed.

The plate 10 is fixed to a printing apparatus P, and then the jig 40 adhered to the substrate 30 is prepared at the entrance of the printing apparatus. By operating the printing apparatus P, the jig 40 is moved to a print head in which the plate 10 is fixed to coincide a reference point of the substrate 30 with a reference point of the plate and the design portions 12 of the design groove 31 and the plate 10.

During the printing the design on the substrate 30, the jig 40 fixing the substrate 30 arrives under the print head where the plate is adhere, the jig 40 is located at a predetermined point and fixed. The print head and plate 10 descend and the plate 10 is in contact with the substrate 30. The print head prints the foam. The foam passes the holes of the design portion of the plate 10 to be set to the design groove 31. After completing printing, the print head and plate 10 go up and the jig 40 is moved to next process.

During the coating the adhesive on the design groove of the printing design on the substrate 30 (S51), an adhesive layer 51 is formed by coating the adhesive on the design groove 31.

The adhesive is a composite including modified epoxy resin, urethane resin, and dilute solvent having excellent coating, short drying time, and improved workability and working speed. The adhesive layer 51 has a predetermined thickness on the circumference of the design groove 31, and the design groove 31 is not projected to the outside.

Non-conformal surfaces of the design groove 31 during the printing the design on the substrate 30 (S50) is arranged by the primer (S52). The primer is coated on the adhesive layer 51 of the design groove 31 in a predetermined thickness to form a primer layer 52.

The primer is made of polyurethane-based aqueous resin. The primer is flame resistance and comprises water of 45 weight % to 55 weight %, polyurethane of 30 weight % to 40 weight %, oxidation decarbromodiphenyl of 5 weight % to 10 weight %, and antimony trioxide (ATO) of 1 weight % to 5 weight %.

The primer layer 52 has a predetermined thickness in the design groove 31 and is not projected outside the design groove 31.

During the printing the design on the substrate 30 (S50) and the printing the foam on the adhesive and the primer in a predetermined thickness (S53), the foam is printed on the adhesive 51 in a predetermined thickness using the printing apparatus to form a foaming layer 53. The foam is a mixture of powder particles around 10 μm and aqueous polyurethane resin. The foaming layer 53 is fixed to the substrate 30 by the adhesive. In this case, a part of the foaming layer 53 may be projected from the surfaces of the substrate 30.

Since the design portion 12 of the plate 10 coincides with the design groove 31, the foam passes the holes of the mesh member to be positioned on the design groove 31 in which the adhesive layer 51 and the primer layer 52 are formed. Thus, the foaming layer 53 is formed on the primer layer 52. Also, since the foam includes a hardening agent with specific ratio in a mixing process for preparing aids such as adhesive or a primer, the hardening agent performs a function as a cross-linking agent between layers of the aids, thereby enhancing adhesion and cohesion between layers. Therefore, printing is exactly performed on a substrate made of leather, and then fixed.

During the forming the color layer (S54) on the foam of the printing the design on the substrate (S50), a composite with a predetermined color is printed on the foaming layer 53 to form a color layer 54. The color layer 54 is made of polyurethane-based oily ink and polycarbonate-based oily ink. The color layer 54 comprises cyclohexanone of 40 weight % to 50 weight %, dimethyl formamide of 5 weight % to 15 weight %, aluminum paste of 10 weight % to 15 weight %, and polyurethane of 20 weight % to 30 weight %.

During the forming a surface layer (S55) on the color layer of the printing the design on the substrate (S50), a polyurethane-based and polycarbonate-based surface treatment are coated on the color layer to form the surface layer 55. As a result, a design layer 50 is completed. The surface layer 55 comprises cyclohexanone of 40 weight % to 50 weight %, dimethyl formamide of 2 weight % to 7 weight %, methyl-ethyl-ketone of 10 weight % to 20 weight %, solvent naphtha (petroleum), light aromatic of 2 weight % to 3 weight %, propylene-glycol-monomethyl-ether-acetate of 3 weight % to 8 weight %, silicon oxide of 3 weight % to 8 weight %, and polyurethane of 20 weight % to 30 weight %.

The surface layer 55 has transparency in order that the color layer 54 is exposed. The surface layer 55 is formed in glossy or in lusterless. The roughness of the surface layer 55 can be various and depends on a design.

During the separating the plate from the substrate and then drying (S60), after drawing the jig 40 and the substrate 30 from the printing apparatus, the jig 40 is separated from the substrate 30 where the design layer 50 is formed. The design layer 50 is projected from the surfaces of the substrate 30 in a predetermined length by the foaming layer 53. The substrate 30 in which the design layer 50 is dried at a temperature ranging from 60° C. to 90° C. for 6 to 12 hours. The substrate 30 is kept and dried in a chamber.

When the substrate 30 is dried at a temperature more than 90° C. and exposed for more than 12 hours, a foam powder capsule is spread in a dry chamber before a foaming process, so that product quality deteriorates. When the substrate 30 is dried at a temperature less than 60° C. and exposed for less than 12 hours, there is a possibility that foam efficiency is reduced.

During the foaming the printed foam (S70), a pressure ranging from 30 bar to 80 bar is applied to the dried substrate 30 at a temperature ranging from 110° C. to 150° C. for 5 to 20 minutes to foam and pressurize the design layer. The foamed design layer 50 on the substrate 30 is fixed by the adhesive layer 51 and a part of the design layer 50 is positioned on the design groove 31 so that the fixation of the design layer 50 is improved to strongly fix the design layer 50 on the substrate 50.

According to embodiments of the present invention, the application fields of natural leather are widen further and various kinds of materials are applicable as the design layer.

Next, a foaming printing method according to another embodiment of the present invention will be described hereinafter.

The foaming printing method according to another embodiment of the present invention can employ the foaming printing method according to the embodiments of FIGS. 1 to 8 as it is.

Referring to FIG. 9, the foaming printing method according to the present embodiment comprises producing and programming a design (S10), forming the design on a plate (S20), arranging surfaces of the substrate (S30), combining the substrate and the plate (S40), printing the design on the substrate (S50), separating the plate from the substrate and drying the substrate (S60), and foaming the foam (S70).

In this case, the substrate is one of a fabric, a glass, and a metal. During the arranging the surfaces of the substrate (S30), the surfaces of the substrate are arranged by coating a primer the surfaces of the substrate in which the design groove is not formed. The plate is fixed to the printing machine and the jig adhered to the substrate is moved to the printing machine to coincide the plate with the substrate, thereby printing the design on the substrate.

A foaming printing method according to an embodiment of the present invention is identical to the method according to the embodiments shown in FIGS. 1 to 8, and so their explanations are omitted to avoid duplication.

However, the surfaces of the substrate are arranged by coating the primer on the substrate. The primer is coated only at a position where a design is formed. Through these processes, the substrate has surfaces in which an adhesive is easily coated and a foam is easily printed. If the primer is coated, the adhesive is coated on the substrate along the design. Other element other than above-mentioned elements can employ the elements of the embodiments shown in FIGS. 1 to 8.

According to the present invention, a surface treatment on the substrate made of a leather is removed to form a design groove at a predetermined depth. Under the condition that the circumference of the design groove is arranged, an adhesive id coated. A foam is foamed on the adhesive, thereby securing adhesion. Thus, the foam is stick to the adhesive to improve design fixation.

All such changes, modifications, variations and other uses and applications which do not depart from the spirit and scope of the invention are deemed to be covered by the invention which is limited only by the claims which follow.

What is claimed is:

1. A foaming printing method comprising:
- producing and programming a design to be formed on a substrate using a computer program;
- forming the design on a plate;
- removing a part of a surface of the substrate along the design;
- combining the substrate and the plate to coincide a designed portion formed on the plate and a removed portion of the substrate;
- printing a foam constituting the design on the substrate that is combined with the plate; and
- separating the plate from the substrate and drying the substrate,
- wherein the foam passes the designed portion of the plate and sets on the removed portion of the substrate during the printing.

2. The foaming printing method of claim 1, wherein the forming of the design on the plate further includes:
- coating a photoresist on the plate;
- printing out the design on a light-transmittable film; and
- combining the plate with the film and removing the photoresist overlapped with the design printed out on the film,
- wherein the photoresist is removed to form the design on the plate.

3. The foaming printing method of claim 1, wherein a design groove constituting the design is formed on the substrate by treating the surface of the substrate using a treatment apparatus inputting the programming during removing the part of the surface of the substrate along the design, and the foam is set into the design groove.

4. The foaming printing method of claim 3, wherein the printing of the foam on the substrate comprises:
- coating an adhesive agent on the design groove;
- forming a primer layer on the adhesive agent;
- printing the foam in a predetermined thickness on the adhesive agent and the primer layer;
- forming a color layer on the foam; and
- forming a surface layer on the color layer.

5. The foaming printing method of claim 3, wherein a depth of the design groove is ranged from 0.05 mm to 0.5 mm from the surface of the substrate.

6. The foaming printing method of claim 3, wherein the treatment apparatus is a laser beam machine and a frequency of the laser beam machine is 6 to 10 kHz and an operating speed of the laser beam machine is 800 to 1,000 mm/sec.

7. The foaming printing method of claim 1, wherein the plate is fixed to a printing apparatus and a jig attached to the substrate is moved to the printing apparatus to coincide the designed portion of the plate with the removed portion of the substrate during the combining the substrate and the plate to coincide the designed portion formed on the plate and the removed portion of the substrate.

8. The foaming printing method of claim 1, wherein the substrate is leather.

9. The foaming printing method of claim 1, wherein the substrate is dried at a temperature ranging from 60° C. to 90° C. for 6 to 12 hours.

10. The foaming printing method of claim 1, wherein a pressure ranging from 30 bar to 80 bar is applied to the substrate at a temperature ranging from 110° C. to 150° C. for 5 to 20 minutes during the applying of the pressure to the foam.

11. A foaming printing method comprising:
- producing and programming a design to be formed on a substrate using a computer program;
- forming the design on a plate;
- arranging a surface of the substrate where the design is to be formed;
- combining the substrate and the plate to coincide the plate and the substrate;
- printing a foam constituting the design on the substrate that is combined with the plate; and
- separating the plate from the substrate and drying the substrate,
- wherein the foam passes a designed portion of the plate and sets on the substrate during the printing.

12. The foaming printing method of claim 11, wherein the plate is fixed to a printing apparatus and a jig attached to the substrate is moved to the printing apparatus to coincide the plate with the substrate.

13. The foaming printing method of claim 12, wherein the substrate is one of a fabric, a glass, and a metal.

14. The foaming printing method of claim 11, wherein the arranging a surface of the substrate comprises:
- forming a primer layer on the surface of the substrate; and
- coating an adhesive agent along the design on the primer layer.

15. The foaming printing method of claim 11, wherein the printing a foam comprises:

printing the foam in a predetermined thickness; and
forming a surface layer on the foam.

* * * * *